United States Patent [19]

Beiswenger et al.

[11] 4,220,284

[45] Sep. 2, 1980

[54] OSCILLATING WATER SPRINKLER

[75] Inventors: John L. Beiswenger, Libertyville; Frank A. Smiesko, McHenry; Dhananjay V. Chaphalkar, Lindenhurst, all of Ill.

[73] Assignee: Burgess Vibrocrafters, Inc., Grayslake, Ill.

[21] Appl. No.: 7,034

[22] Filed: Jan. 29, 1979

[51] Int. Cl.[3] ..... B05B 3/16

[52] U.S. Cl. ..... 239/242; 91/339; 91/346; 92/125

[58] Field of Search ..... 91/339, 346; 92/125; 418/146, 147; 239/237, 240, 242, 246, 590.5

[56] References Cited

U.S. PATENT DOCUMENTS

| | | | |
|---|---|---|---|
| 2,110,112 | 3/1938 | Rippey | 239/590.5 X |
| 2,942,789 | 6/1960 | Smith | 239/242 X |
| 3,066,654 | 12/1962 | Matt | 92/125 |
| 3,613,519 | 10/1971 | Southall | 92/125 |
| 3,767,118 | 10/1973 | Oberto et al. | 239/242 |

*Primary Examiner*—Andres Kashnikow
*Attorney, Agent, or Firm*—Darbo & Vandenburgh

[57] ABSTRACT

A snap-action toggle valve reverses the direction of an oscillating sprinkler powered by a paddle-piston motor. Adjustable stops on the sprinkler tube trip the valve at the end of each sweep, alternately opening left and right motor chamber channels interconnected to a sprinkler supply channel feeding the sprinkler tube without interruption. A special vane on the sprinkler tube where it intercepts the sprinkler supply channel prevents vortex action. The edges of the paddle-piston are sealed to the motor chamber by a flanged slip-on wiper.

12 Claims, 16 Drawing Figures

6
7
5
5b
13a
15
17
14a
1
13
11
2
9
10
4
12
3
5c
8

3
14a
13a
6
17
5c
8
13
14
11
12
4

1
3
4
4
4
5a
5b
5c
5d
6
6
6
6a
6a
7
8
9
10
11
12
13
13a
14
14a
15
16
17
18
18a
18b
18c
19
20
21
21
22
22
22
22a
22b
23
24
25
26
26a
26a
26b
27
38
39a
41
41a
41'
4.
4.

Fig. 4.
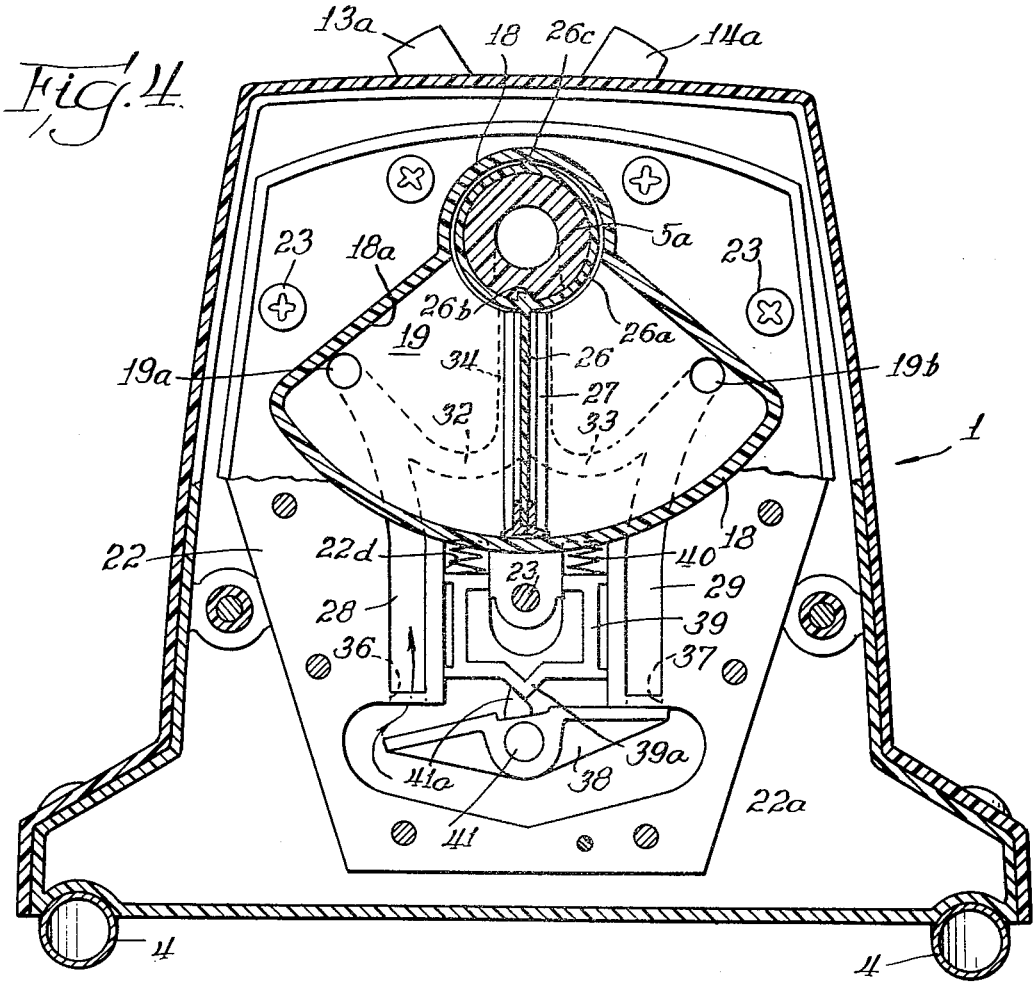
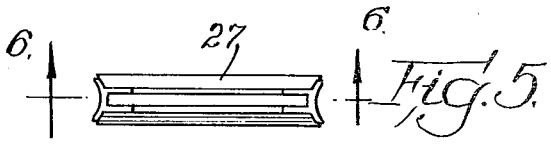
Fig. 5.
Fig. 6.
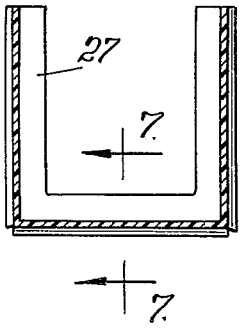
Fig. 7.
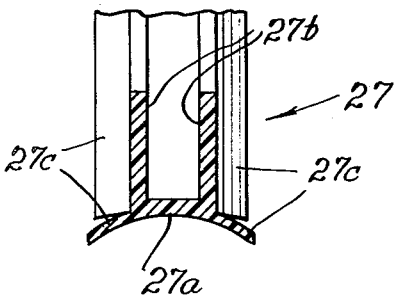

18a
18b
19a
18
18c
19
19b
28
31
33
32
29
12
39
39a
38
38b
12
41a
41
12
11
12

38a
38
41
41a
11
12

OSCILLATING WATER SPRINKLER

BACKGROUND AND SUMMARY OF THE INVENTION

A great variety of lawn sprinklers has been devised and manufactured. All are intended to distribute water as uniformly as possible over a given lawn area at the rate at which the water will soak into the ground. Some are simple sprinkler manifolds with no moving parts. Some provide for a multiplicity of streams from nozzles which rotate about a vertical or horizontal axis, and many are adjustable to limit the area to be sprinkled at any given setting. The constantly moving streams are preferable in that they spread the water for a given location of the sprinkler over a larger area for optimum absorption. While sprinklers rotating about a vertical axis supply water to a circular area, sprinklers which oscillate about a horizontal axis serving a rectangular area are generally preferred because the entire lawn can be uniformly watered by successively sprinkling areas with straight common boundries.

To achieve improved certainty and continuity of operation and uniform watering for a given setting, horizontal oscillating sprinklers have become increasingly complex with concomitantly increasing cost and mechanical failure probability.

Paddle-piston-type horizontal oscillating sprinklers have been designed to switch the routing of streams of water by fluid action alone to minimize the number of moving parts, as in U.S. Pat. Nos. 3,767,118 and 3,829,018, owned by the assignee of the present application. Some of these sprinkler designs employ a "fluidic" type of flow circuitry in which when one stream starts to flow, it deflects another stream to an alternate position.

While these designs were effective over the range of pressures at which water is usually supplied for residential service, an oscillating water sprinkler capable of satisfactory operation over a wider range of water pressures and having a switching mechanism as nearly independent of water pressure and immune to line pressure fluctuation as possible within practical limits would have obvious advantages.

Another object of the invention is to improve upon the "squeegee" or "revolving door" type wiper flange, disclosed in the above-identified patents, which seals the paddle-piston to the motor chamber and to generally improve the delivery of water to the sprinkler.

These and other objects of the invention are achieved by employing a snap-action toggle valve to reverse the direction of an oscillating sprinkler powered by a paddle-piston motor. Adjustable stops on the sprinkler tube actuate the valve at the end of each sweep, alternately opening left and right motor chamber channels interconnected to a sprinkler supply channel feeding the sprinkler tube without interruption. A special vane on the sprinkler tube where it intercepts the sprinkler supply channel prevents vortex action. The edges of the paddle-piston are sealed to the walls of the motor chamber by a separate flexible, double-flanged, slip-on wiper element.

The achievements and advantages of the oscillating water sprinkler of this invention will become more fully apparent as the description thereof proceeds in connection with the accompanying drawings.

DESCRIPTION OF THE DRAWINGS

FIG. 4 is a cross-sectional view taken at line 4—4 of FIG. 3.

FIG. 5 is a top detail view of the paddle-piston wiper element for the sprinkler of FIGS. 1–4.

FIG. 6 is a cross-sectional view of the wiper element taken along the line 6—6 of FIG. 5.

FIG. 7 is a cross-sectional view of the wiper element taken along the line 7—7 of FIG. 6.

DESCRIPTION OF SPECIFIC EMBODIMENT

Figure 1:
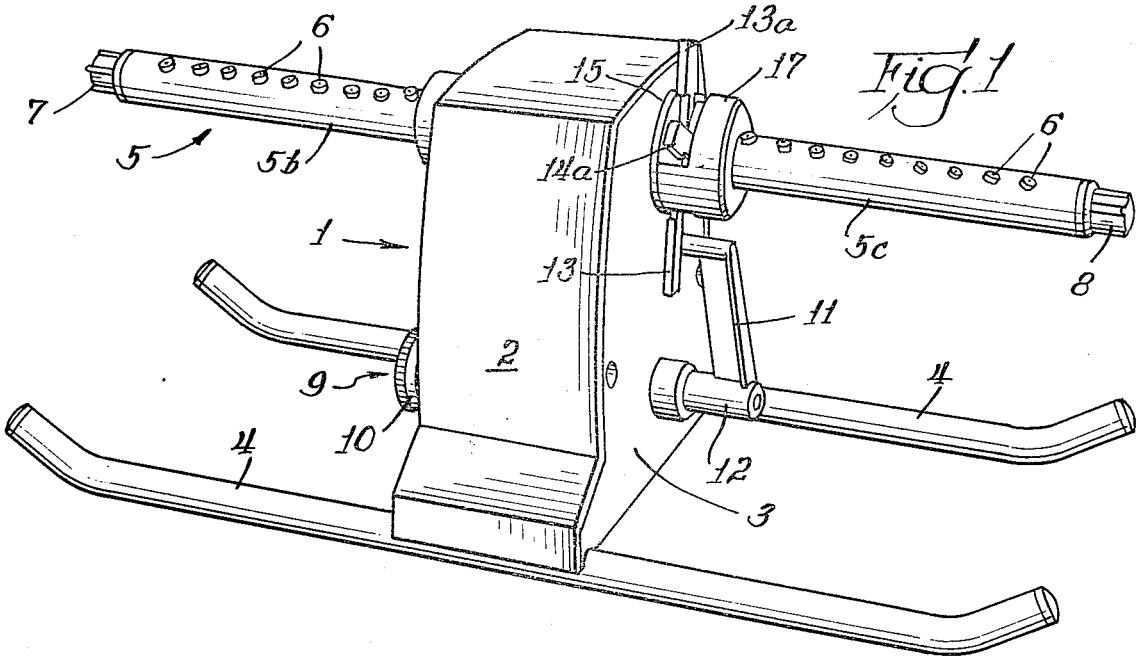
FIG. 1 is a perspective view of the oscillating water sprinkler of the invention.
Figure 3:
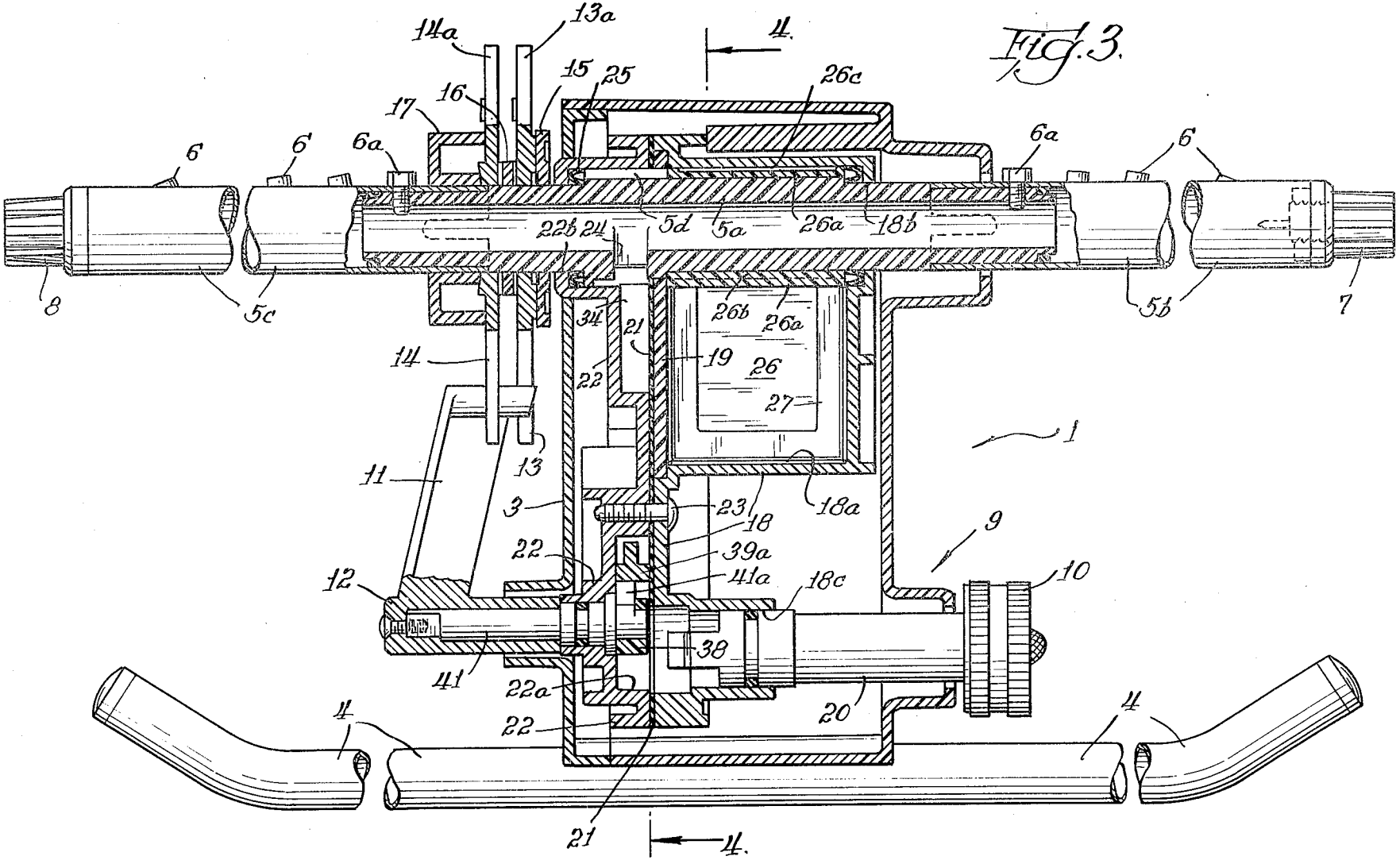
FIG. 3 is a cross-sectional view taken at the line 3—3 of FIG. 2.

As seen in FIG. 1, the sprinkler comprises a base including a housing 1 having sides 2 and ends 3 mounted upon supporting legs 4. Sprinkler tube 5, which may be essentially straight, comprises interior middle sleeve **5*a* (FIG. 3) and nozzle manifold tubes 5*b* and 5*c*, these tubes being provided with rows of spaced nozzles 6 which may be progressively increasingly tilted outwardly to provide a uniform sprinkling fan pattern throughout the width of the rectangular lawn area sprinkled for a particular setting of the sprinkler. Each manifold tube 5*b* and 5*c* is affixed and sealed to the middle sleeve 5*a* by means of a threaded nozzle 6*a* and an O-ring as shown in FIG. 3. The ends of the sprinkler tube 5 are closed by plugs 7 and 8**.

An inlet snout 9 equipped with a hose coupling 10 projects from the rear of the housing for connection of the water supply hose to the sprinkler. Lever 11, mounted for movement back and forth about its hub 12, projects through the front 3 of the housing for engagement of stops 13 and 14. Lever 11 is the activating lever of the sprinkler tube oscillating control valve. Stops 13 and 14 are adjustable by manual rotational manipulation of the respective handle ends **13*a* and 14*a*. The stop assembly is mounted on one end of the sprinkler middle sleeve 5*a* and is carried in oscillation with the sprinkler tube assembly. Adjustable stops 13 and 14 are sandwiched between washers 15, 16 and 17 (FIG. 3). Outer washer 17 has an integral cylindrical cover fastened to washer 15 with screws (not shown). The handle ends 13*a* and 14*a* of the stops project through a circumferential slot in the cover of washer 17 which limits their angular separation. Preferably, the middle washer 16 is a crown gear with radial grooves like a poker chip engaging identical facing surfaces on the coaxial ring-like portions of stops 13 and 14**.

When the predetermined end of a sweep in one direction is reached, stop 13 or 14, as the case may be, engages the end of lever 11 and moves it so as to switch a toggle valve which routes water through alternate channels, as will be described in detail hereinafter, to effect reversal of the direction of rotation of the sprinkler tube for the return sweep with eventual engagement of the other stop with the end of lever 11, to continue the oscillation of the sprinkler tube.

The housing 1 of the sprinkler is composed of two moldings, one forming the top, bottom, both sides 2 and the rear which has the water inlet 9. The other molding forms the front 3 through which the switch lever hub 12 projects. The internal structure of the sprinkler, as shown in FIG. 3, is mounted entirely within the first or larger of these two housing parts and includes a motor chamber molding 18 forming the motor chamber 18*a*. When closed by the cover plate 19, the motor chamber forms a coaxial sector of an annular disc. The motor chamber molding 18 also provides upper coaxial opening 18*b* through which the paddle-piston hub and middle sprinkler sleeve 5*a* pass and lower opening 18*c* which receives the O-ringed end of the hose coupling connector 20. Adjacent to the paddle chamber molding 18, separated by a flat gasket 21, is a plate circuit molding 22 which is connected to the paddle chamber molding 18 by means of screws 23. The plate circuit 22 has channels defined therein for routing water from the inlet snout 9 and hose connector 20 into the interior of the sprinkler tube 5 via circumferential intake port 24 formed through sleeve 5*a* and simultaneously up into the motor chamber 18*a* by one of two paths.

The plate circuit molding 22 has a switch chamber 22*a* which communicates with the opening 18*c* in the motor chamber molding to receive supply water and an upper coaxial opening 22*b l through which the middle sleeve 5a* passes. U-cup seals 25 make a watertight connection for the middle sleeve 5*a* as it rotates in the aligned coaxial openings in the motor chamber molding 18, cover 19, gasket 21 and circuit plate molding 22. The middle sleeve has a short axially projecting vane 5*d* which prevents vortex action of the water exiting supply channel 34 by prohibiting the water from circulating around the outside of middle sleeve 5*a*. Prevention of the vortex action enhances flow from the supply channel 34 through the intake port 24.

As shown in FIGS. 3 and 4, a vane-like paddle-piston 26 is located within the water chamber 18*a*. The paddle-piston 26 includes an integrally molded hub 26*a* coaxial with the sprinkler tube and middle sleeve and a rectangular blade which extends radially from the hub in a plane parallel to its axis and occupies nearly the entire cross-sectional area of the motor chamber 18*a*. The paddle-piston hub 26*a* has an internal axial key 26*b* received in a complementary keyway on the corresponding external surface of the middle sleeve 5*a* which fits inside and rotates with the paddle-piston hub.

On the opposite side of the paddle-piston hub 26*a*, a small axial rib 26*c* projects from the exterior surface of the hub forming an obstruction in the annular channel between the hub 26*a* and the coaxial opening 18*b* in the motor chamber molding, thereby serving as a bearing surface for the paddle-piston 26. The rib 26*c* also prevents water in the motor chamber on one side of the paddle-piston from communicating with the other side of the paddle-piston and motor chamber through the coaxial opening 18*b*.

The paddle-piston blade is fitted with a U-shaped, frame-like, double-flanged, slip-on sealing wiper 27, preferably of injection molded polyethylene, which engages and slides along the walls of the motor chamber, as shown in detail in FIGS. 5–7. The wiper includes a base portion 27*a* and two parallel flanges 27*b* extending axially therewith. The parallel flanges grip the edge of the paddle-piston. A pair of outwardly flared flanges 27*c* extend from the base portion 27*a*, opposite the parallel flanges 27*b*. The outwardly flared flanges 27*c* provide sealing, sliding contact with the motor chamber 18*a*.

Paddle-piston blade 26 with its sealing wiper 27 divides the motor chamber 18*a* into two watertight compartments with a movable common partition rotatable back and forth through about ninety degrees of arc without losing its seal.

Ports 19*a* and 19*b* permit the flow of water under supply pressure into one compartment of the motor chamber and permit the flow of water out of the other compartment of the motor chamber (and ultimately joining the main flow to the nozzles 6) to drive the paddle-piston 26 in rotation one way or the other. A toggle valve assembly connects ports 19*a* and 19*b* alternately to the water supply and the sprinkler tube 5.

Figure 8:
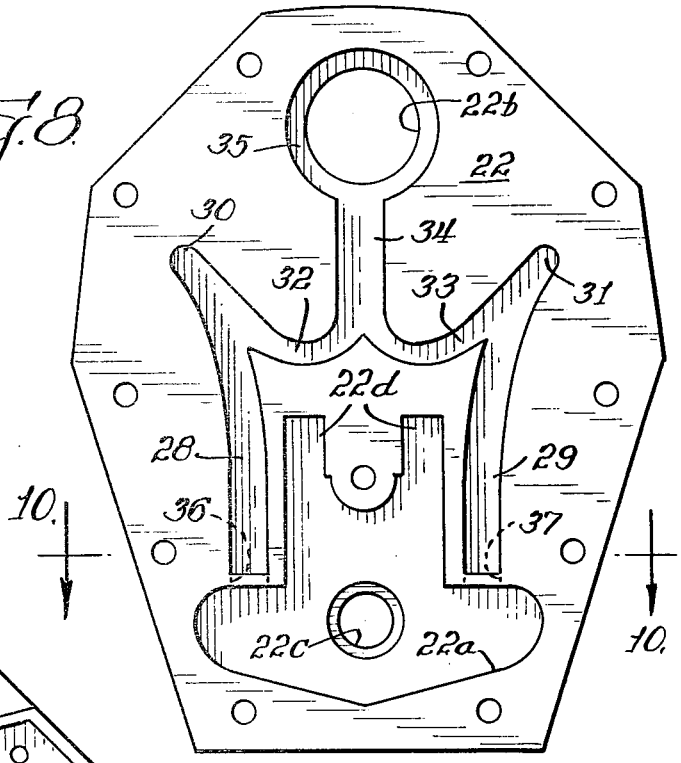
FIG. 8 is a front detail view of the circuit plate of the sprinkler of FIGS. 1–4.
Figure 9:
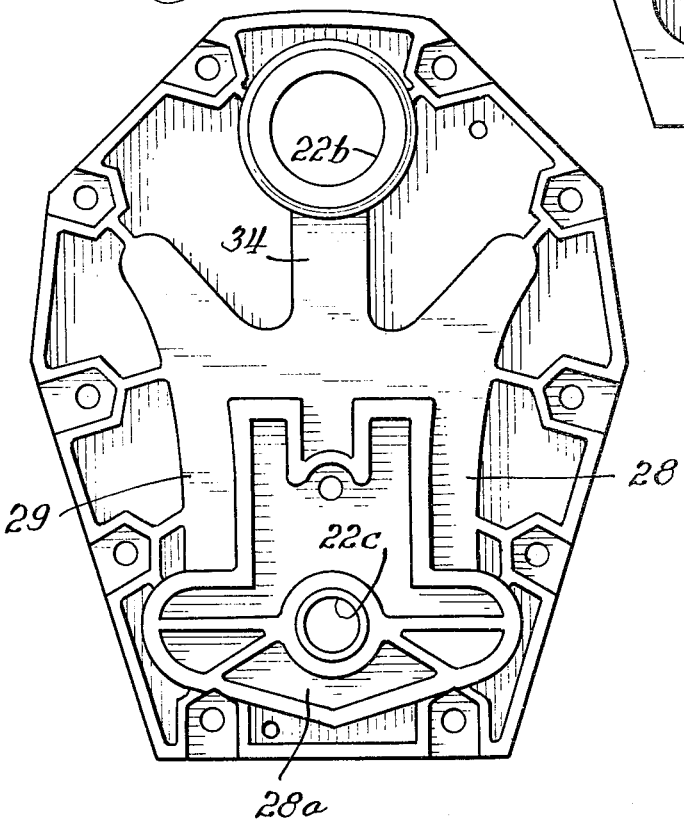
FIG. 9 is a rear detail view of the circuit plate of FIG. 8.

As shown in FIGS. 8 and 9, the switch chamber 22*a*, shaped like an inverted mushroom slice, has its lower oblong area (cap) in direct communication with the hose connector 20. A stepped circuit opening 22*a* (FIG. 9) is located in the middle of the lower oblong area of the switch chamber 22*a* through the back of the circuit plate molding 22. The top (stem) of the switch chamber 22*a* defines two parallel spring chambers 22*d*.

Figure 10:
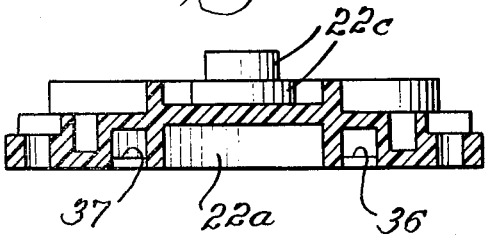
FIG. 10 is a sectional view of the circuit plate taken along line 10—10 of FIG. 8.

Left and right motor chamber filling channels 28 and 29, respectively, are defined in the circuit plate molding 22 and extend along either side of upper stem portion 22*d* of the swtich chamber and curve or flare slightly outwardly up to circular junction points 30 and 31, respectively, which coincide respectively with ports 19*a* and 19*b* of the motor chamber cover plate. The junction points 30 and 31 are also connected via respective curved merging discharge channels 32 and 33 to a single main sprinkler tube supply channel 34 which leads to an annular channel 35 coaxially defined around the circumference of the sprinkler tube opening 22*b* in the circuit plate through which the middle sleeve 5*a* is rotatably received. The merging channels 28 and 32 on one side form a cursive V-shape as do the complementary merging channels 29 and 33 on the other side of the circuit plate. FIG. 10 shows the "windows" or inlet ports 36 and 37 through which the switch chamber 22*a* communicates with the left and right filling channels 28 and 29. The channels, chambers and openings formed in the circuit plate molding 22 are all symmetrical with respect to the orthogonal plane through the centers of openings 22*b* and 22*c*.

As shown in FIG. 4, a rocker 38 serves as a toggle valve and is pivotally mounted in the switch chamber 22*a* so that in its extreme alternate positions it blocks one or the other of inlet ports 36 and 37, thus alternately connecting the left and right filling channels 28 and 29 to the water supply via the switch chamber 22*a*. A U-shaped cam follower 39 with a pointed bottom projection 39*a* is slidably received in the stem portion of the switch chamber 22*a* so that the legs of the follower fit in the spring chambers 22*d*. Coil compression springs 40 are inserted in the remainder of the upper ends of the chamber 22*d* to urge the follower downwardly.

Figures 11, 12:
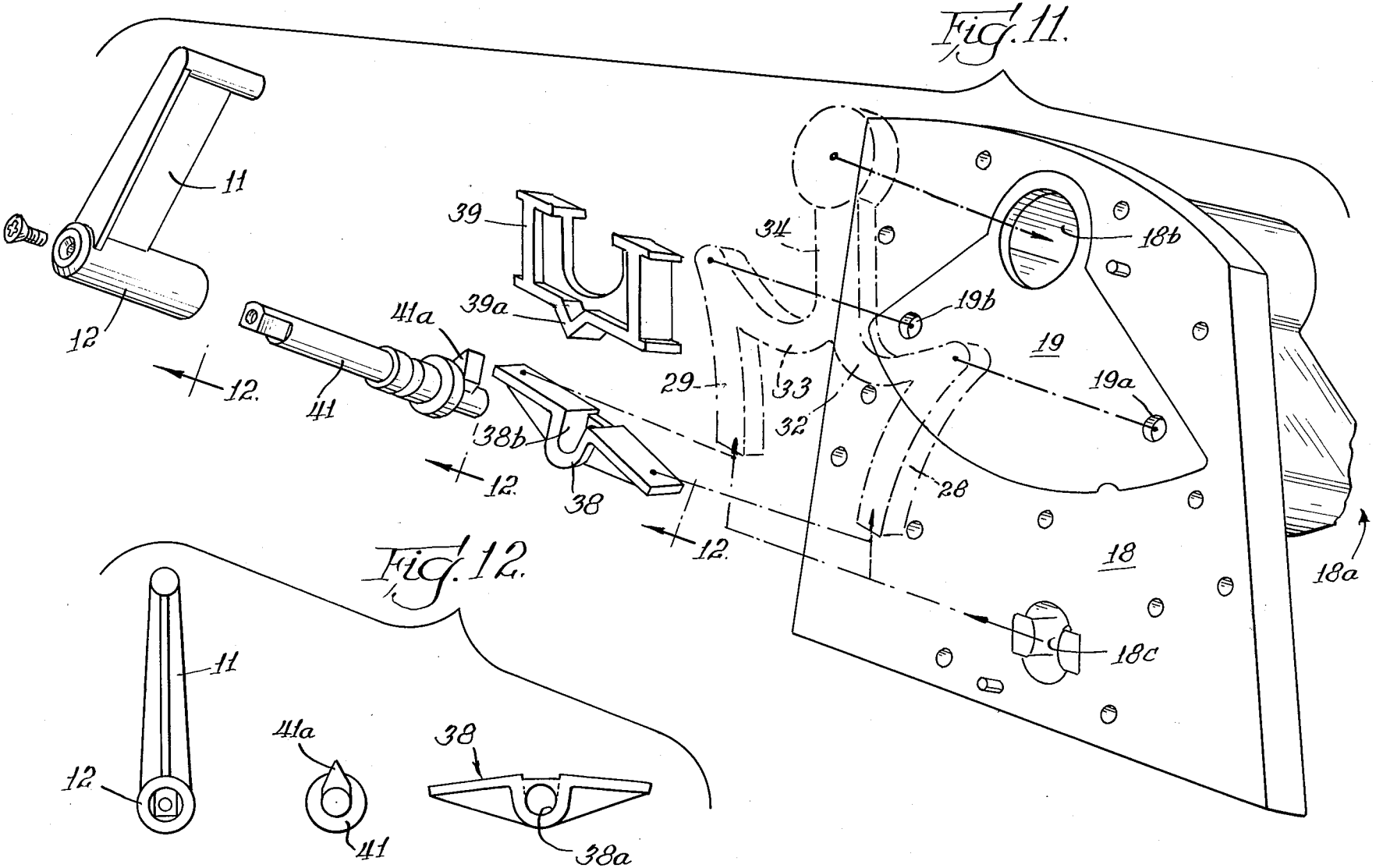
FIG. 11 is an axially exploded perspective view of the lever, cam shaft and rocker for the sprinkler of FIGS. 1–4 shown in relation to the cam follower and paddle chamber molding with the fluid channels in phantom.
FIG. 12 is composed of three rear axial views of the lever, cam shaft and rocker from left to right, respectively, as indicated by the lines 12 of FIG. 11.

Cam shaft 41 is sealingly and rotatably received through the stepped opening 22*c* in the circuit plate molding 22. The rocker 38 is pivotally mounted on the end of the cam shaft 41. The outer (left in FIG. 3) end of the cam shaft 41 projects through the front plate 3 to receive the keyed hub 12 of the switch lever 11 which may be secured by a screw. The inner end of the cam shaft 41 in the switch chamber carries the pointed cam surface 41*a* (see FIG. 11) which engages the cam follower 39. The cylindrical inner end of the cam shaft 41 is rotatably received in the central circular opening 38 (FIG. 12) of the rocker. The cam shaft can turn freely within the rocker 38 over an arc limited by the engagement of the side of the cam 41*a* with one side or the other of the U-shaped opening 38*b* in the rocker. There is enough rotational "play" between the cam shaft and the rocker that the cam shaft may rotate slightly past top dead center (where the follower is fully raised) in either direction without disturbing the position of the rocker.

In FIG. 4 the paddle-piston 26 is centered in the motor chamber 18*a* in the middle of a counterclockwise sweep as is indicated by the arrows showing flow into and out from the chamber. Water in the switch chamber 22*a* is flowing through the open inlet port 36, up the left filling channel 28 and into the left compartment of the motor chamber through port 19*a*. The right-hand compartment of the motor chamber 18*a* is being emptied through port 19*b* via the discharge channel 33. Water rushing through the curved discharge channel 33 into the sprinkler supply channel 34 tends to aspirate water from the merging left discharge channel 32 thus dividing the water from the left filling channel 28 into two streams: one flowing into the motor chamber and the other joining the sprinkler supply channel 34 which supplies water to the sprinkler tube 5.

Figure 2:
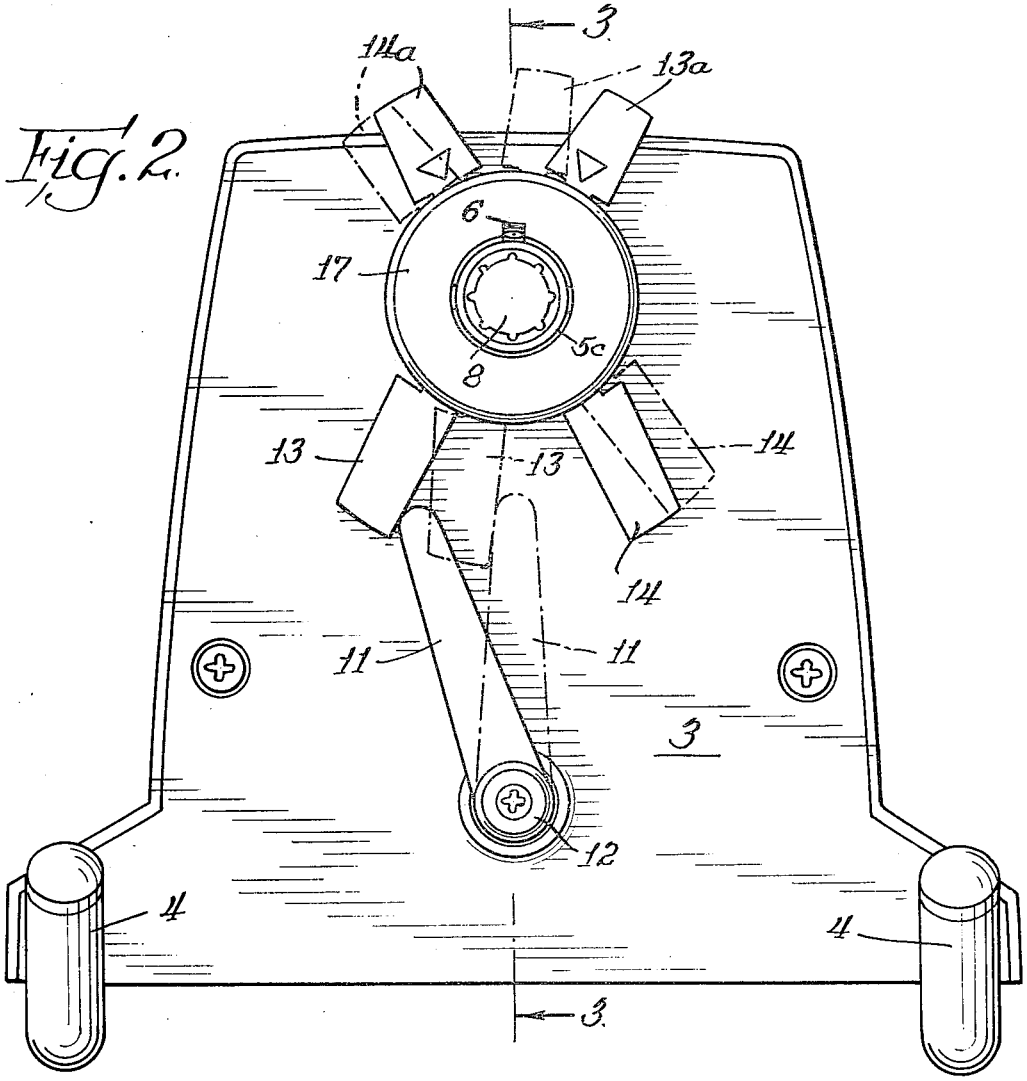
FIG. 2 is a front view of the sprinkler of FIG. 1.
Figure 13:
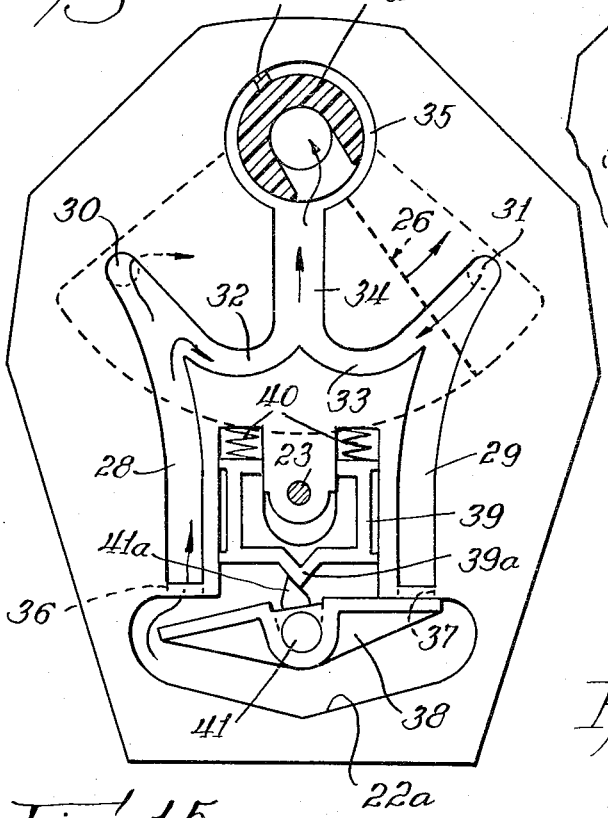
FIGS. 13–16 are diagrammatic views of the internal water channels with the motor chamber and paddle-piston in phantom showing the operation of the snap-action valve at consecutive points in one operating cycle.
Figure 14:
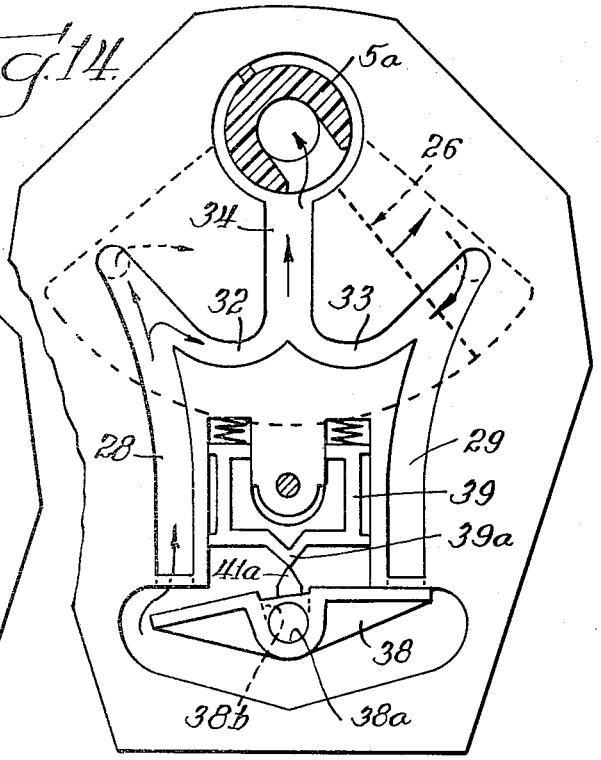
Figure 15:
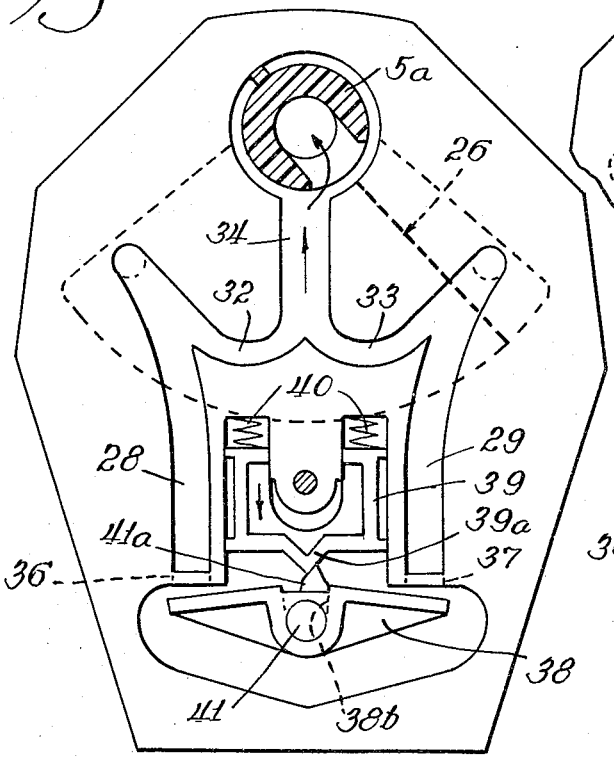
Figure 16:
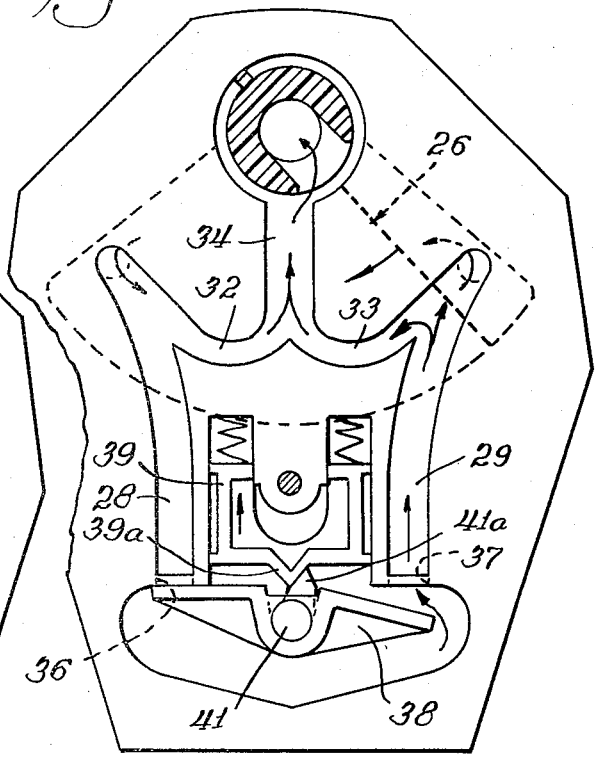

With reference to FIGS. 4 and 13–16, the situation of the switch mechanism remains unchanged until the paddle-piston has turned counterclockwise through almost its entire arc and is reaching its right-hand extremity (FIG. 13). At this point, the stop 14 (FIG. 2), which rotates with the paddle-piston, engages the end of the switch lever 11 turning the cam shaft 41. Cam 41*a* begins to force the cam follower 39 upwards. The position of the rocker and the flow pattern remain unchanged, however, and the motor chamber continues to fill from the left. When the cam is at top dead center, point-to-point with the follower (FIG. 14), the snap-action valve is fully "cocked." As the cam moves past top dead center, the valve is "triggered" and the follower 39 is urged downward by the compressed springs 40 without opposition (FIG. 15). The downward motion of the follower is unopposed since the cam shaft 41 can turn freely in the rocker until the side of cam 41*a* engages the side of the U-shaped opening 38*b* in the rocker. Before the downward traveling follower bottoms out against the upper surface of the rocker 38, the accelerated cam 41*a* strikes the rocker, thus opening the right inlet port 37 and pivoting the rocker clockwise against the left inlet port 36 (FIG. 16) to stop the flow of water to channel 28. Immediately, the right filling channel 29 communicates with the water pressure in the switch chamber 22*a*. The motor chamber 18*a* starts filling from the right, instead of from the left, which starts the paddle-piston 26 turning clockwise for the return cycle. As there is no time at which both channels 28 and 29 are closed off from the water pressure, there is never an interruption in the water service through the nozzles 6, and the rapid positive switching mechanism ensures minimum dwell at the end point of each sweep.

ACHIEVEMENTS

The major objective and accomplishment of the invention described above is the realization of far wider operating margins without greatly increasing manufacturing costs or sacrificing sprinkler performance. Because of the powerful action of the large area paddle-piston, the resistance of the coil springs in the snap-action toggle valve is easily overcome, whether the water pressure is high or low, over the full range of pressures at which water is usually supplied for residential service. Activation of the toggle valve depends solely on movement of the paddle-piston past a predetermined point. Moreover, once the toggle valve is "tripped" by virtue of passing top dead center, the action of the valve is self-completing under the power of the coil springs, not water pressure. Once switched to the alternate stable position, the rocker can remain there indefinitely, independent of water pressure or the presence of a control stream. Moreover, transient fluctuations in pressure have no effect. As a result, the actuation of the switch requires only enough pressure to keep the paddle-piston moving and maintenance of either stable position is completely independent of water pressure. These attributes allow the sprinkler to be used with assurance in areas with widely varying water pressures.

In addition, an improved one-piece, slip-on, wiper flange has been disclosed, which facilitates assembly and further provides a complete double seal operative in the same positive manner in either direction. The new wiper more effectively seals and divides the motor chamber compartments improving the efficiency of the paddle-piston by keeping leakage to a minimum.

Finally, a relatively minor disturbance in flow from the sprinkler supply channel into the sprinkler tube has been alleviated by providing integrally with the sprinkler tube, and without additional manufacturing difficulty, a special antivortex van to prevent water from circulating around the outside of the sprinkler tube at the intake port.

With these improvements, the sprinkler described above achieves improved performance, greater ease of assembly of certain parts and wider operating margins over varying water pressure conditions without drastically altering the design of the sprinkler or increasing its manufacturing cost, while retaining the paddle-piston-motor feature which ensures maximum reliability in oscillating water sprinklers, the best type of sprinkler for home use.

We claim:

1. In an oscillating water sprinkler having a base with a horizontal sprinkler tube mounted therein for oscillating motion about its axis, a water supply inlet, a fluid motor comprising a chamber having a paddle-piston arranged therein drivingly secured to the sprinkler tube, left and right motor chamber filling channels, left and right motor chamber discharge channels, means for connecting the motor chamber discharge channels to the sprinkler tube, valve means for routing the flow of water alternately along one or the other of the left and right motor chamber filling channels and control means for manipulating said valve means in response to the angular position of the sprinkler tube, the improvement wherein said valve means includes a two-position mechancial closure element arranged to alternately directly close one or the other of the inlets to the left and right filling channels and switch means for independently propelling said closure element alternately from one position to the other when actuated by the movement of said paddle-piston past a predetermined point and for mechanically urgingly holding said closure element in said other position independent of water pressure.

2. Structure in accordance with claim 1, wherein said switch means includes a cam shaft rotatably mounted in said base and a cam follower positioned to operatively engage said cam shaft and means urging said follower against said cam shaft, said closure element being formed by a rocker pivotally mounted on said cam shaft.

3. Structure in accordance with claim 2, wherein said switch means further includes limit means formed on said rocker for engaging said cam shaft and causing said rocker to rotate with said cam shaft, said limit means being positioned so as to engage said cam shaft when said cam shaft is rotated in one direction to a predetermined point past top dead center with respect to the action of said follower.

4. Structure in accordance with claim 3, wherein said cam shaft includes a pointed cam and said follower includes a pointed bottom projection operatively engaging said cam whereby once said cam is past top dead center where said cam and follower are point-to-point, the cam shaft is propelled under the power of said urging means to suddenly engage and switch said rocker from one position to the other.

5. Structure in accordance with claim 4, wherein said control means for manipulating said valve means includes a lever arm connected to said cam shaft and means connected for rotation with the sprinkler tube for engaging said lever arm to turn said cam shaft at a particular angular position of the sprinkler tube.

6. Structure in accordance with claim 1, wherein the outlet ends of the discharge channels merge together to form a single sprinkler supply channel leading to the sprinkler tube such that flow from one of the discharge channels tends to aspirate fluid from the other.

7. Structure in accordance with claim 1, wherein the inlets of the left and right chamber discharge channels merge respectively with the outlets of the left and right chamber filling channels to form a common left chamber fill/discharge port and a common right chamber fill/discharge port.

8. In an oscillating water sprinkler having a base with a horizontal sprinkler tube mounted therein for oscillating motion about its axis, a water supply inlet, a fluid motor comprising a chamber having a paddle-piston arranged therein drivingly secured to the sprinkler tube, left and right motor chamber filling channels, left and right motor chamber discharge channels, means connecting the outlets of the motor chamber discharge channels to the sprinkler tube, valve means for routing the flow of water alternately along one or the other of the left and right motor chamber filling channels and control means for manipulating said valve means in response to the angular position of the sprinkler tube, the improvement wherein the left and right motor chamber discharge channels merge together to form a single sprinkler supply channel leading to the sprinkler tube such that flow from one discharge channel into the sprinkler supply channel tends to aspirate fluid from the other.

9. Structure in accordance with claim 8, wherein the inlets to the left and right chamber discharge channels are merged respectively with the outlets of the left and right chamber filling channels to form a common left chamber fill/discharge port and a common right chamber fill/discharge port.

10. In an oscillating water sprinkler having a base with a horizontal sprinkler tube mounted therein for oscillating motion about its axis, a water supply inlet, a fluid motor comprising a sector-shaped chamber having a rotatably mounted paddle-piston drivingly secured to the sprinkler tube with a substantially rectangular blade extending radially within and dividing the chamber in a plane parallel to the axis thereof, and means for providing and controlling the flow of water to supply the sprinkler tube and the fluid motor, the improvement wherein a U-shaped slip-on double-flanged flexible wiper is fitted to the paddle-piston blade to slidably seal the edges thereof to the sides of the motor chamber.

11. Structure in accordance with claim 10, wherein said wiper includes an elongated base portion, two parallel flanges extending axially therewith and spaced so as to grip the edge of the paddle-piston blade and, on the opposite side of said base portion, a pair of outwardly flared flanges extending therewith for sealing, sliding contact with the inside wall of the motor chamber.

12. Structure in accordance with claim 11, wherein said wiper is formed of a single plastic molding.

* * * * *

UNITED STATES PATENT AND TRADEMARK OFFICE

CERTIFICATE OF CORRECTION

PATENT NO. : 4,220,284

DATED : September 2, 1980

INVENTOR(S) : John L. Beiswenger, Frank A. Smiesko and Dhananjay V. Chaphalkar

It is certified that error appears in the above-identified patent and that said Letters Patent are hereby corrected as shown below:

| | |
|---|---|
| Col. 3, ls. 39 and 40 | after "22b" delete "l"; "through which the middle sleeve 5a" should be regular type not italic. |
| Col. 4, l. 31 | "circuit" should be --circular-- |
| Col. 4, l. 31 | "22a" should be --22c-- |
| Col. 6, l. 43 | "van" should be --vane-- |

Signed and Sealed this

*Twenty-fifth* Day of *November 1980*

[SEAL]

*Attest:*

SIDNEY A. DIAMOND

*Attesting Officer*

*Commissioner of Patents and Trademarks*